US006425143B1

(12) United States Patent
Benedict et al.

(10) Patent No.: US 6,425,143 B1
(45) Date of Patent: Jul. 30, 2002

(54) HELMET WITH VENTILATION FOR FOG MANAGEMENT AND RESPIRATION

(75) Inventors: Tim Benedict; Brad Kosel, both of Thief River Falls, MN (US)

(73) Assignee: Arctic Cat, Inc., Thief River Falls, MN (US)

( * ) Notice: Subject to any disclaimer, the term of this patent is extended or adjusted under 35 U.S.C. 154(b) by 0 days.

(21) Appl. No.: 09/778,832

(22) Filed: Feb. 8, 2001

(51) Int. Cl.[7] ..... A42B 1/08
(52) U.S. Cl. ..... 2/424; 2/171.3
(58) Field of Search ..... 2/424, 171.3, 9, 2/425

(56) References Cited

U.S. PATENT DOCUMENTS

| | | | | |
|---|---|---|---|---|
| 4,475,254 | A | * | 10/1984 | Bay |
| 4,514,864 | A | * | 5/1985 | Huber |
| 4,667,348 | A | * | 5/1987 | Sundahl |
| 4,704,746 | A | * | 11/1987 | Nava |
| 4,794,652 | A | * | 1/1989 | Piech von Planta et al. |
| 5,058,212 | A | * | 10/1991 | Kamata |
| 5,093,938 | A | * | 3/1992 | Kamata |
| 5,148,550 | A | * | 9/1992 | Hodgkinson et al. |
| 5,394,566 | A | * | 3/1995 | Hong |
| 5,694,650 | A | * | 12/1997 | Hong |
| 6,105,172 | A | * | 8/2000 | Shida |

FOREIGN PATENT DOCUMENTS

| | | | |
|---|---|---|---|
| DE | 3419302 | * | 11/1985 |
| GB | 2186194 | * | 8/1987 |

* cited by examiner

*Primary Examiner*—Rodney M. Lindsey
(74) *Attorney, Agent, or Firm*—Merchant & Gould, P.C.

(57) ABSTRACT

A helmet having ventilation for fog management and respiration. The helmet has a shell shaped to define a cavity for a wearer's head. A transparent shield is engaged with the shell. The shell and shield cooperate to fully enclose the wearer's head. The shield is moveable between an open and a closed position. The shield has a visor attached thereon and moveable therewith. The helmet has at least one first air inlet and first air outlet. The shell and the inner surface of the shield cooperate to define a first airflow path that enables air to enter through the first air inlet, flow across the inner surface of the shield to draw off moisture from inner surface of the shield to control fogging thereof, and exit through the first air outlet. The helmet also has at least one second air inlet and second air outlet. The shell defines a second airflow path that enables air to enter from the cavity through the second air inlet and exit through the second air outlet, so that air exhaled by the wearer is carried away to the second air outlet. The helmet may include a separator that separates the first airflow path from the cavity. The separator may have at least one third inlet and third air outlet to allow air to pass through the separator along the first airflow path. The helmet may include at least one fourth air inlet to produce an increased draft within the second airflow path.

17 Claims, 4 Drawing Sheets

HELMET WITH VENTILATION FOR FOG MANAGEMENT AND RESPIRATION

BACKGROUND OF THE INVENTION

This invention relates to a helmet, and more particularly to a helmet with ventilation for controlling the formation of fog on a shield thereof, and for respiration of a person wearing the helmet.

Helmets are well known, and are commonly used to protect the head from impacts, debris, etc. during activities including but not limited to vehicle operation. Generally, helmets comprise a shell made of a suitably durable material with a cavity therein for the head.

It will be appreciated that a helmet that completely encloses the head provides the greatest possible protection. Thus, it is common to equip helmets with a transparent shield to cover the eyes, to protect them while still permitting clear vision. Likewise, it is common for helmets to cover the nose and mouth and chin area completely.

However, this configuration has a number of problems. For example, air exhaled by the wearer of the helmet is warm and humid. In a conventional fully enclosed helmet, moisture from the exhaled air has no place to escape, and thus tends to collect on the inner surfaces of the helmet. This is of special concern with respect to the shield, since even a relatively small amount of moisture condensation or "fogging" on the inner surface of the shield can obscure the wearer's vision significantly. This is a disadvantage in particular for helmets meant to be worn in cold environments, as fogging becomes more severe when the shield is chilled. In addition, the air inside the helmet rapidly becomes hot, humid, and stuffy, making the helmet uncomfortable to wear.

Two methods conventionally are used to overcome these limitations. First, helmets have been equipped with air vents in order to permit the exchange of air with the outside. However, the airflow has proven to be less than satisfactory, and fogging of the shield remains a common problem. In addition, airflow generally has been inadequate to cool the helmet to the point where it may be worn comfortably for extended periods.

Second, it is known to eliminate the shield, leaving the area around the eyes open and unprotected. This certainly eliminates the fogging problem, but requires the wearing of a separate piece of eye protection such as a pair of goggles. It will be appreciated that this is a considerable inconvenience. Furthermore, even with goggles, such a helmet leaves a significant portion of the wearer's face exposed. In high winds or cold temperatures, this can be uncomfortable. Indeed, in sufficiently hostile conditions, as those experienced by persons operating snowmobiles, there is a risk of injury due to excessive cold.

In addition to these difficulties, in a conventional fully enclosed helmet that incorporates a shield, it is not possible to include a visor. Shields are conventionally designed to be raised from a closed to an open position so as to permit conversation, adjustment of goggles, etc. If a visor is included with a conventional helmet, however, it blocks the movement of the shield to the open position. For this reason, known helmets may include either a shield or a visor, but not both.

SUMMARY OF THE INVENTION

Therefore it is the purpose of the present invention to overcome the deficiencies of the existing designs. It is the purpose of the present invention to provide a helmet that protects substantially the entire head while having sufficient ventilation both to control fogging of the shield and to provide sufficient air for respiration. It is a further purpose of the present invention to provide a helmet with sufficient ventilation to allow it to be worn comfortably for extended periods.

An embodiment of a helmet in accordance with the principles of the present invention comprises a shell that defines a cavity therein. The shell is adapted to enclose the head of a person wearing the helmet. The helmet includes a transparent shield engaged with the shell, the shield being moveable between open and closed positions.

The shell has at least one first air inlet and at least one first air outlet. The shell and the inner surface of the shield cooperate to define a first airflow path from the first air inlet, across the inner surface of the shield, and through the first air outlet. Thus, the inner surface of the shield is constantly in the path of air outside air moving through the helmet via the first airflow path. The outside air draws off moisture from the vicinity of the shield, minimizing moisture condensation or "fog" on the shield.

The shell also has at least one second air inlet and at least one second air outlet. The shell defines a second airflow path from the second air inlet to the second air outlet. The cavity of the helmet is in communication with the second airflow path via the second air inlet, so that exhaled air is carried away and does not accumulate within the helmet.

Another embodiment of a helmet in accordance with the principles of the present invention further comprises a separator. The separator is adapted to separate the first airflow path from the cavity.

Still another embodiment of a helmet in accordance with the principles of the present invention further comprises a visor engaged with the shield and moveable therewith.

BRIEF DESCRIPTION OF THE DRAWINGS

Like reference numbers generally indicate corresponding elements in the figures.

DETAILED DESCRIPTION OF THE PREFERRED EMBODIMENT

Figure 1:
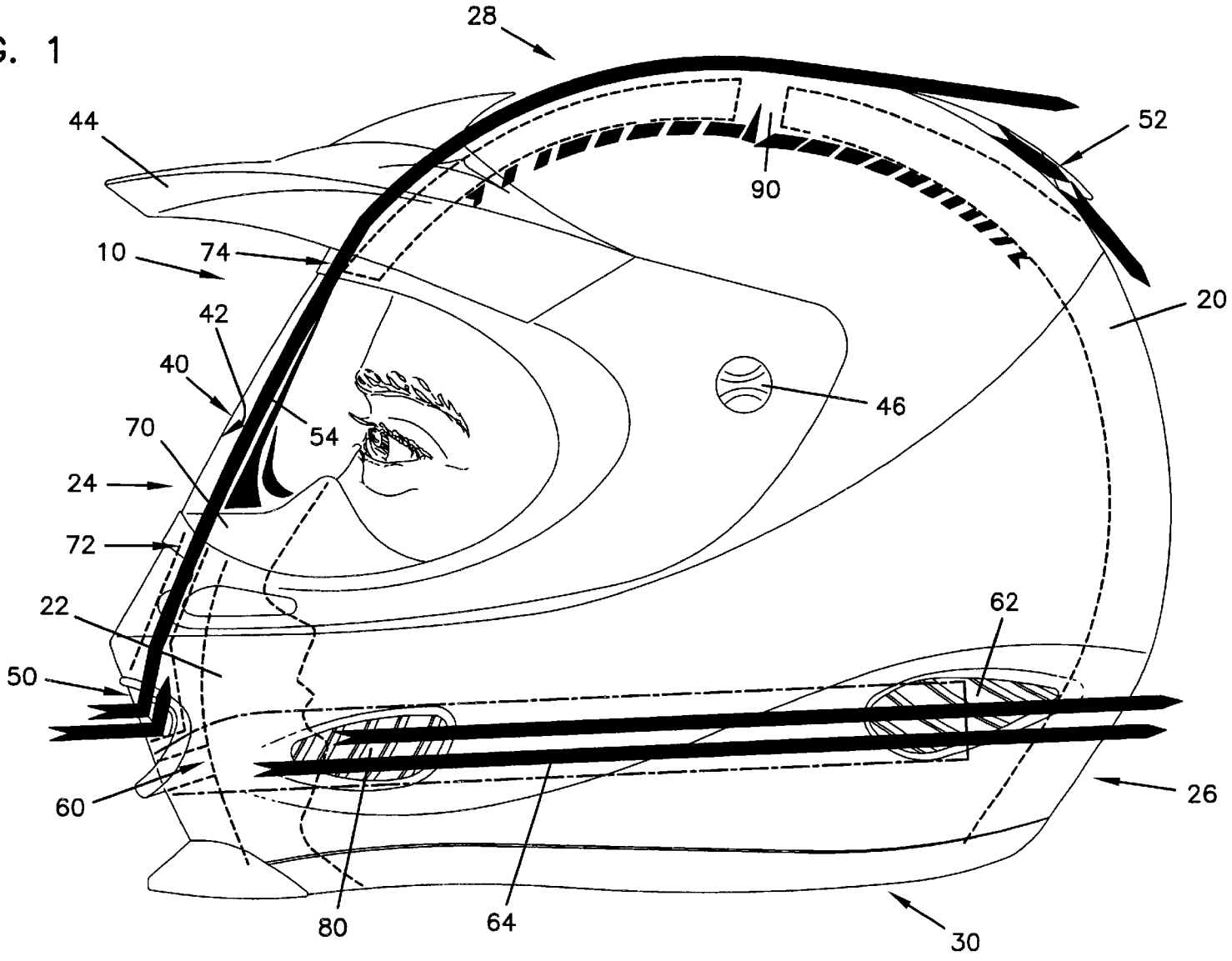
FIG. 1 is a side schematic view of a helmet in accordance with the principles of the present invention, with the shield in a closed position.
Figure 2:
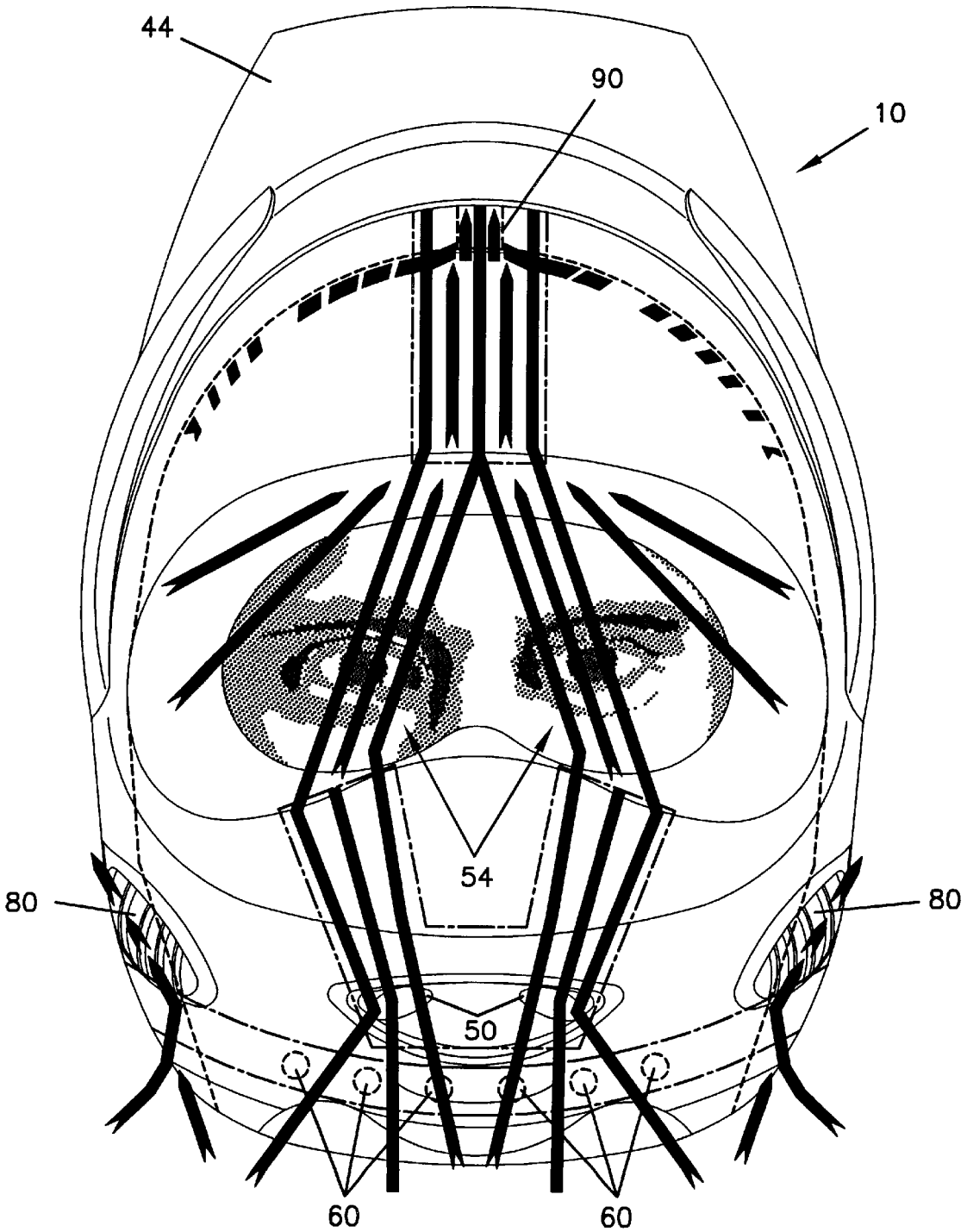
FIG. 2 is a front view schematic view of the embodiment shown in FIG. 1, with the shield in an open position.
Figure 3:
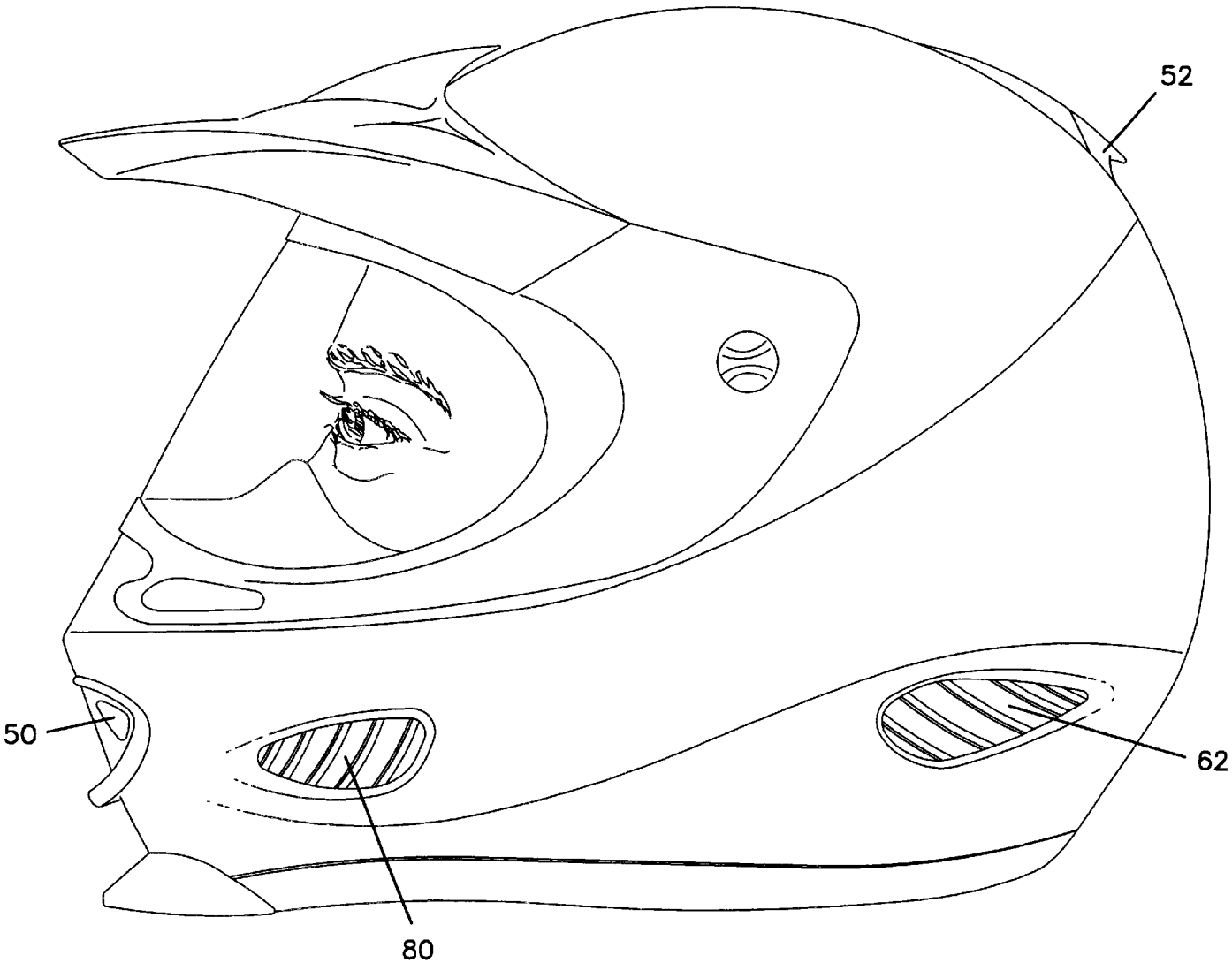
FIG. 3 is a side perspective view of the embodiment shown in FIG. 1, with the shield in a closed position.
Figure 4:
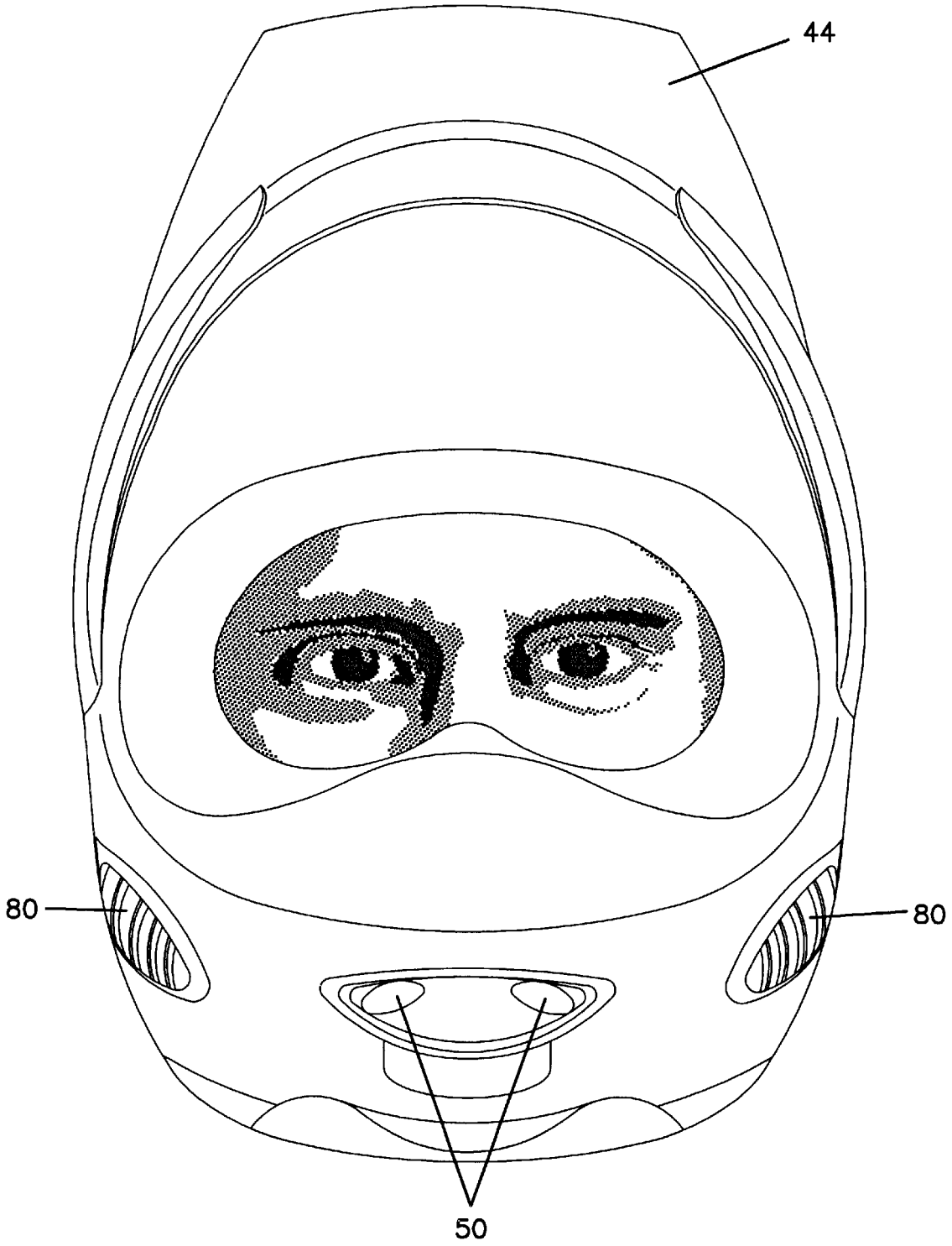
FIG. 4 is a front perspective view of the embodiment shown in FIG. 1, with the shield in an open position.

Referring to Figure, 1, the present invention comprises a helmet 10. As illustrated, the helmet 10 comprises a shell 20. The shell 20 defines a cavity 22 therein. The shell 20 is adapted to substantially enclose the head of a person wearing the helmet 10, when the wearer's head is placed within the cavity 22. The shell 20 may comprise any suitably durable material, including but not limited to metal, solid or foamed plastic, and fiberglass. The shell 20 may comprise multiple layers of material, such as a rigid outer layer and a padded inner layer. The shell 20 may be formed as a single piece, or may comprise a plurality of pieces secured together. It will be apparent to those knowledgeable in the art that the embodiment illustrated is exemplary only, and that a wide variety of shapes, styles, and configurations of helmet 10 may be equally suitable.

The helmet 10 further comprises a shield 40 engaged with the shell 20. The shield 40 comprises an inner surface 42. The shield 40 is substantially transparent, and is configured so as to permit light to penetrate therethrough. The shield 40 may comprise any suitable transparent material, including but not limited to glass and plastic. The shield 40 may be tinted, polarized, printed with a pattern, or otherwise conditioned so as to limit the light passing therethrough, or may be essentially colorless.

The shield 40 is moveable between an open position, wherein airflow into the helmet 10 past the shield 40 is enabled, and a closed position, wherein airflow into the helmet 10 past the shield 40 is not enabled. Advantageously, the shield comprises a locking member 46 adapted to lock the shield in at least the upper or the lower position. Locking mechanisms are well known, and are not further detailed herein. As illustrated, the locking member 46 is located on a pivot joint between the shield 40 and the shell 20. However, it will be apparent to those knowledgeable in the art that this configuration is exemplary only, and that other locations or configurations of locking means 46, or none at all, may be equally suitable.

The shield 40 further comprises a visor 44 connected thereto, and moveable therewith. Advantageously, the visor 44 may be removably connected to the shield 40, e.g. with a screw connection. Such means for removable connection are well known, and are not further detailed herein. However, it will be apparent to those knowledgeable in the art that this configuration is exemplary only, and that it may be equally suitable for the visor 44 to be fixed immovably to the shield 40, or to be integral with it.

The shell 20 comprises at least one first air inlet 50 and at least one first air outlet 52. The shell 20 cooperates with the inner surface 42 of the shield 40 to define a first airflow path 54 through the helmet 10. The first airflow path 54 is configured such that air enters through the first air inlet 50, flows through the first airflow path 54 along the inner surface 42 of the shield 40, and then exits through the first air outlet 52. In this configuration, air from outside the helmet carries away moisture that has collected or might collect on the inner surface 42 of the shield 40.

As illustrated the helmet 10 comprises two first air inlets 50 disposed proximate the bottom 30 and the front 24 of the helmet 10. However, it will be apparent to those knowledgeable in the art that this configuration is exemplary only, and that different numbers, locations, and shapes of first air inlets 50 may be equally suitable.

Similarly, as illustrated the helmet 10 comprises one first air outlet 52 disposed proximate the top 28 and the back 26 of the helmet 10. However, it will be apparent to those knowledgeable in the art that this configuration is exemplary only, and that different numbers, locations, and shapes of first air outlets 52 may be equally suitable.

The shell 20 further comprises at least one second air inlet 60 and at least one second air outlet 62. The shell 20 defines a second airflow path 64 that extends through the helmet 10 from the second air inlet 60 to the second air outlet 62. The second airflow path 64 is in communication with the cavity 22 via the second air inlet 60, so that air flows therebetween. The second air inlet 60 connects the cavity 22 to the second airflow path 64, but does not connect either the cavity 22 or the second airflow path 64 to the outside of the helmet 10. The second airflow path 64 is configured such that exhaled air from the air cavity 22 enters the second airflow path 64 through the second air inlet 60, flows through the second airflow path 64, and then exits through the second air outlet 62.

As illustrated the helmet 10 comprises six second air inlets 60 disposed proximate the bottom 30 and the front 24 of the helmet 10. However, it will be apparent to those knowledgeable in the art that this configuration is exemplary only, and that different numbers, locations, and shapes of second air inlets 60 may be equally suitable.

Similarly, as illustrated the helmet 10 comprises two second air outlets 62 disposed proximate the bottom 30 and the back 26 of the helmet 10. However, it will be apparent to those knowledgeable in the art that this configuration is exemplary only, and that different numbers, locations, and shapes of second air outlets 62 may be equally suitable.

The first and second airflow paths may be configured in various manners. In particular, the first and second airflow paths may be defined wholly within a rigid outer layer of the shell. The first and second airflow paths may also be defined wholly within a padded inner layer of the shell. However, it will be apparent to those knowledgeable in the art that these configurations are exemplary only, and that the first and second airflow paths may be defined within some other layer, or within a combination of layers.

Advantageously, the helmet 10 comprises a separator 70 adapted to cooperate with a wearer's head so as to separate the first airflow path 54 from the cavity 22. The separator 70 thus acts to reduce the flow of moisture from within the cavity 22 to the inner surface 42 of the shield 40. The separator 70 is engaged with at least one of the shell 20 and the shield 40. As illustrated, the separator comprises a gasket engaged with the shell 20, and adapted to seal to the wearer's face around the eyes. This is advantageous, in that it separates the wearer's respiratory orifices (nose and mouth) from the first airflow path 54, thereby restricting the flow of exhaled moisture to the inner surface 42 of the shield 40. However, it will be apparent to those knowledgeable in the art that this is exemplary only, and that a wide variety of configurations of separator 70, including but not limited to configurations that separate the first airflow path 54 from the wearer's respiratory orifices, may be equally suitable.

The separator 70 may comprise any suitable material, including but not limited to cloth, rubber, and flexible or rigid plastic foam. Similarly, the separator 70 may engage with the shell 20, the shield 40, or both, in any suitable manner, including but not limited to fittings, adhesive, and hook-and-loop tape. Advantageously, the separator may be removable for cleaning or replacement.

The separator 70 defines at least one third air inlet 72 and at least one third air outlet 74 therethrough. The third air inlet 72 and the third air outlet 74 are configured to allow air traveling along the first airflow path to pass through the separator 70, so as to flow along the inner surface 42 of the shield 40 with the separator 70 in place.

Advantageously, the shell 20 comprises at least one fourth air inlet 80 that is in communication with the second airflow path 64. In this way, air may enter through the fourth air inlet 80 and create an increased draft in the second airflow path 64 towards the second air outlet 62, so as to carry away exhaled air efficiently. Additionally, the fourth air inlet 80 may provide a convenient source of fresh air for the wearer. Advantageously, the fourth air inlet 80 is positioned such that air enters the second airflow path 64 through the fourth air inlet 80 at a point that is closer to the second air outlet 62 than the second air inlet 60 is. That is, the fourth air inlet 80 is "downstream" from the second air inlet 60. Given such a configuration, air entering through the fourth air inlet 80 may produce a draft within the second airflow path 64 towards the second air outlet 62 without causing a draft of outside air to blow directly across the face of a person wearing the helmet 10. This is particularly advantageous in cold weather, when drafts of cold outside air may prove especially uncomfortable. However, it will be apparent to those knowledgeable in the art that this configuration is exemplary only, and that different configurations of fourth air inlets 80 with respect to the second air inlets 60 may be equally suitable.

As illustrated the helmet 10 comprises two fourth air inlets 80 disposed proximate the bottom 30 and the front 24 of the helmet 10. However, it will be apparent to those knowledgeable in the art that this configuration is exemplary only, and that different numbers, locations, and shapes of fourth air inlets 80 may be equally suitable.

Advantageously, one or more of the first air inlet 50, first air outlet 52, second air inlet 60, second air outlet 62, and fourth air inlet 80 may be adjustable, so that the flow of air therethrough may be restricted or completely prevented. Adjustable air inlets and outlets are well known, and are not detailed further herein.

Advantageously, the helmet 10 may comprise at least one vent 90 connecting the cavity 22 with the first airflow path 54. The cavity 22 thus being in communication with the first airflow path 54, air may flow from the cavity 22 through the vent 90 and into the first airflow path 54, and thence out through the first air outlet 52. In this way, heat and moisture may be removed from the cavity 22, allowing for greater comfort when the helmet 10 is worn.

Advantageously, the helmet 10 may be configured such that at least one of the first and second airflow paths 54 and 64 is defined at least in part by the head of the wearer. For example, the helmet 10 may be configured such that the shell 20 and the wearer's head are separated, with air flowing between them along part of the first airflow path 54.

It will be apparent to those knowledgeable in the art such a configuration is exemplary only, and helmets 10 having different portions of the first or second airflow paths 54 and 64 defined by the wearer's head, or having no portion defined by the wearer's head, may be equally suitable.

The above specification, examples and data provide a complete description of the manufacture and use of invention. Since many embodiments of the invention can be made without departing from the spirit and scope of the invention, the invention resides in the claims hereinafter appended.

We claim:

1. A helmet, comprising:

a shell defining a cavity therein, said shell being adapted to substantially enclose a head within said cavity, said shell having a front end and a back end and a top and a bottom, said shell comprising at least one first air inlet adapted to admit air from outside said helmet, at least one first air outlet adapted to release air from inside said helmet, at least one second air inlet adapted to admit air from inside said helmet, and at least one second outlet adapted to release air from inside said helmet;

a substantially transparent shield comprising an inner surface, said shield being engaged with said shell so as to allow light to enter said cavity through said shield;

a separator engaged with at least one of the shell and the shield, said separator being adapted to separate said first air flow path from said cavity, said separator comprising a gasket engaged with said shell, said gasket being adapted to seal to a wearer's head proximate the eyes so as to enable vision through said shield while preventing communication between said cavity and said inner surface of said shield;

wherein said shell and said inner surface of said shield cooperate to define a first airflow path from said at least one first air inlet to said at least one first air outlet such that air flowing through said first airflow path flows along said inner surface of said shield;

wherein said shell defines a second airflow path from said at least one second air inlet to said at least one second air outlet;

wherein said cavity is in communication with said second airflow path; and wherein said gasket defines at least one third air inlet and at least one third air outlet, such that said first airflow path extends from said at least one first air inlet to said at least one third air inlet, across said inner surface of said shield to said at least one third air outlet, and to said at least one first air outlet.

2. The helmet according to claim 1, wherein said separator is comprised of a flexible foam.

3. The helmet according to claim 1, further comprising a visor connected to said shield and moveable therewith.

4. The helmet according to claim 3, wherein said visor is removably connected to said shield.

5. The helmet according to claim 1, wherein said shield comprises locking means adapted to lock said visor in at least one of said open and closed positions.

6. The helmet according to claim 1, wherein said at least one first air inlet is disposed proximate said front end of said helmet and proximate said bottom of said helmet.

7. The helmet according to claim 1, wherein said at least one first air outlet is disposed proximate said back end of said helmet and proximate said top of said helmet.

8. The helmet according to claim 1, wherein said at least one second air inlet is disposed proximate said front end of said helmet and proximate said bottom of said helmet.

9. The helmet according to claim 1, wherein said at least one second air outlet is disposed proximate said back end of said helmet and proximate said bottom of said helmet.

10. The helmet according to claim 1, further comprising at least one fourth air inlet, said at least one fourth air inlet being in communication with said second air flow path, said at least one fourth air flow inlet being closer to said at least one second air outlet than said second air inlet, whereby air entering said at least one fourth air inlet generates a draft through said second air flow path such that air is urged towards said at least one second air outlet.

11. The helmet according to claim 10, wherein said at least one fourth air inlet is disposed proximate said front end of said helmet and proximate said bottom of said helmet.

12. The helmet according to claim 1, wherein at least one of said at least one first air inlet, said at least one first air outlet, said at least one second air inlet, and said at least one second air outlet, is adjustable to control air flow therethrough.

13. The helmet according to claim 10, wherein said at least one fourth air inlet is adjustable to control air flow therethrough.

14. The helmet according to claim 1, wherein at least one of said first airflow path and said second airflow path is defined at least partially by a wearer's head in cooperation with said shell.

15. The helmet according to claim 1, further comprising at least one vent connecting said cavity to said first airflow path, said at least one vent being closer to said at least one first air outlet than said shield.

16. A method of producing air flow in a helmet, said helmet comprising:

shell defining a cavity therein, said shell being adapted to substantially enclose a head within said cavity, said shell comprising at least one first air inlet adapted to admit air from outside said helmet, at least one first air outlet adapted to release air from inside said helmet, at least one second air inlet adapted to admit air from inside said helmet, and at least one second outlet adapted to release air from inside said helmet;

a substantially transparent shield comprising an inner surface, said shield being engaged with said shell so as to allow light to enter said cavity through said shield;

a separator engaged with at least one of the shell and the shield, said separator comprising a gasket engaged with said shell, said gasket being adapted to seal a wearer's head proximate the eyes so as to enable vision through said shield while preventing communication between said cavity and said inner surface of said shield, the gasket defining at least one third air inlet and at least one third air outlet;

the method comprising the steps of:

defining a first airflow path from said at least one first air inlet to said at least one third air inlet, across said inner surface of said shield to said at least one third air outlet, and to said at least one first air outlet such that air flowing through said first airflow path flows against said inner surface of said shield, and such that said separator separates said first air flow path from said cavity;

defining a second airflow path from said at least one second air inlet to said at least one second air outlet, wherein said cavity is in communication with said second airflow path.

17. The helmet according to claim 1, wherein said shield is moveable between a closed position, wherein airflow into said helmet past said shield is not enabled, and an open position, wherein airflow into said helmet past said shield is enabled.

* * * * *